US008899149B2

(12) United States Patent
Oka

(10) Patent No.: US 8,899,149 B2
(45) Date of Patent: Dec. 2, 2014

(54) LETTERPRESS PRINTING PLATE

(75) Inventor: Yuji Oka, Osaka (JP)

(73) Assignee: Sumita Company Ltd., Osaka (JP)

( * ) Notice: Subject to any disclaimer, the term of this patent is extended or adjusted under 35 U.S.C. 154(b) by 1715 days.

(21) Appl. No.: 12/153,866

(22) Filed: May 27, 2008

(65) Prior Publication Data

US 2009/0145316 A1 Jun. 11, 2009

(30) Foreign Application Priority Data

Dec. 11, 2007 (JP) ..... 2007-319631
Jan. 30, 2008 (JP) ..... 2008-18642

(51) Int. Cl.
*B41N 1/12* (2006.01)
*B41C 1/02* (2006.01)
*B41C 1/00* (2006.01)

(52) U.S. Cl.
CPC . *B41N 1/12* (2013.01); *B41C 1/025* (2013.01); *B41C 1/003* (2013.01)
USPC ..... 101/395

(58) Field of Classification Search
None
See application file for complete search history.

(56) References Cited

U.S. PATENT DOCUMENTS

2002/0189471 A1* 12/2002 Juffinger et al. ..... 101/401.1

FOREIGN PATENT DOCUMENTS

| | | | |
|---|---|---|---|
| CN | 1236933 | C | 1/2006 |
| JP | 2002-019323 | A | 1/2002 |
| JP | 2003-039626 | A | 2/2003 |
| JP | 2004-188983 | A | 7/2004 |
| JP | 2005-301071 | | 10/2005 |
| JP | 2007-185917 | A | 7/2007 |

OTHER PUBLICATIONS

Notification of Reasons for Refusal mailed Jul. 14, 2009, issued on the Japanese patent application No. 2008-018642 and the English translation thereof.
First Notification of Office Action dated Jul. 5, 2011, issued for the Chinese patent application No. 200810098408.1 and English translation thereof.

* cited by examiner

*Primary Examiner* — Joshua D Zimmerman
(74) *Attorney, Agent, or Firm* — Edwards Wildman Palmer LLP

(57) ABSTRACT

A letterpress printing plate, made of a material having flexibility, includes a plurality of raised parts to applying ink to, the raised parts including a raised part for solid shade, and a buildup part formed at a backside position of the raised part for solid shade with respect to the printing plate.

2 Claims, 3 Drawing Sheets

LETTERPRESS PRINTING PLATE

The present application claims priority under 35 U.S.C. §119 of Japanese Patent Application No. 2007-319631 filed on Dec. 11, 2007 and Japanese Patent Application No. 2008-18642 filed on Jan. 30, 2008, the disclosure of which is expressly incorporated by reference herein in its entity.

BACKGROUND OF THE INVENTION

1. Field of the Invention

The present invention relates to a letterpress printing plate.

2. Description of the Related Art

Letterpress printing is a printing method utilizing recessed and raised parts of a plate, wherein non-image areas are recessed and image areas are raised, and ink applied to the raised parts is transferred to a substrate made of synthetic resin film, paper, etc.

Such letterpress printing methods includes typographic printing that uses a plate with the combination of movable types, photoengraving, line photoengraving and the like, polymer letterpress printing that uses a photopolymer plate in place of a typographic printing plate, and flexography that uses a plate of rubber or photopolymer and supplies a press plate with ink via an anilox roller.

At present, polymer letterpress printing, flexography and rubber plate printing using printing plates formed of a material having flexibility are the mainstream methods in letterpress printing.

In printing plates used for these printing methods, recessed and raised parts corresponding to the patterns to be printed are created by photolithography, laser processing or other techniques.

For example, a letterpress printing plate formed by a photolithography technique is produced by steps of: forming a mask corresponding to a print pattern to be printed on a photopolymer plate; irradiating the photopolymer plate with light via the mask and expose the same to light; and removing the mask and developing the photopolymer plate (see, for example, Japanese Patent Application Laid-Open No. 2005-301071).

In this type of letterpress printing plate, two kinds of raised parts are formed: raised parts for solid shade, whose entire surface transfers ink to a printing substrate such as synthetic resin film or paper, and raised parts for halftone shade, by which so-called halftone dots are printed. These two kinds of raised parts are commonly used in printing plates for resin letterpress printing, flexography and rubber plate printing.

When such a letterpress printing plate is wounded on a cylindrical roll of a printing machine to conduct printing, the same pressure is applied to raised parts for solid shade and raised parts for halftone shade. Hence, if higher priority is given to obtaining excellent printing quality in solid shade areas, halftone areas will be printed in a squashed manner. If higher priority is given to obtaining excellent printing quality in halftone areas, solid areas may sometimes be printed blurrily.

In other words, contact area of per unit area of a solid part is larger than contact area per unit area of a halftone part. As such, when the same pressure per unit area is applied to both a halftone part and a solid part, the pressure per contact area is larger in the halftone part than in the solid part.

Therefore, if higher priority is given to obtaining excellent printing quality in solid parts (when a pressure appropriate for solid parts is applied), excess pressure is applied to halftone parts, so that the halftone parts will be printed squashed (spreaded too much).

On the other hand, if higher priority is given to obtaining excellent printing quality in halftone parts (when a pressure appropriate for halftone parts is applied), the pressure is insufficient for solid parts, and thus the solid parts will be printed blurrily.

SUMMARY OF THE INVENTION

It is an object of the present invention to provide a letterpress printing plate in which the above problems can be solved.

In accordance with an aspect of the present invention, a letterpress printing plate, made of a material having flexibility, includes a plurality of raised parts to applying ink to, the raised parts including a raised part for solid shade, and a buildup part formed at a backside position of the raised part for solid shade with respect to the printing plate.

In accordance with another aspect of the present invention, a letterpress printing plate, made of a material having flexibility, includes a plurality of raised parts to applying ink to, and a plurality of buildup parts formed at backside positions of the raised parts with respect to the printing plate. The raised parts may include a raised part for solid shade and a raised part for halftone shade. The buildup parts may include a buildup part for solid shade, being thickest of all the buildup pats and formed at a backside position of the raised part for solid shade; and a buildup part for halftone shade, being of a thickness smaller than the buildup part for solid shade, the thickness being set in accordance with a halftone percentage of the halftone.

The above buildup parts may be formed of ink ejected by an inkjet printing machine.

Effect of the Invention

A letterpress printing plate of the present invention, made of a material having flexibility, includes a plurality of raised parts to applying ink to, the raised parts including a raised part for solid shade, and a buildup part formed at a backside position of the raised part for solid shade with respect to the printing plate. Therefore, when the letterpress printing plate is set on a printing machine, the raised part for solid shade is higher than a raised part for halftone shade in a halftone part by the thickness of the buildup part. Accordingly, an sufficient pressure is appropriately applied to the solid part while an appropriate pressure is also applied to the halftone part, so that excellent printing quality can be obtained for both the solid part and the halftone part.

If the buildup parts are formed using an inkjet printing machine, there is a merit that the buildup parts can be accurately and conveniently formed based on positional information of each raised part inputted previously into an inkjet printing machine.

Figure 1:
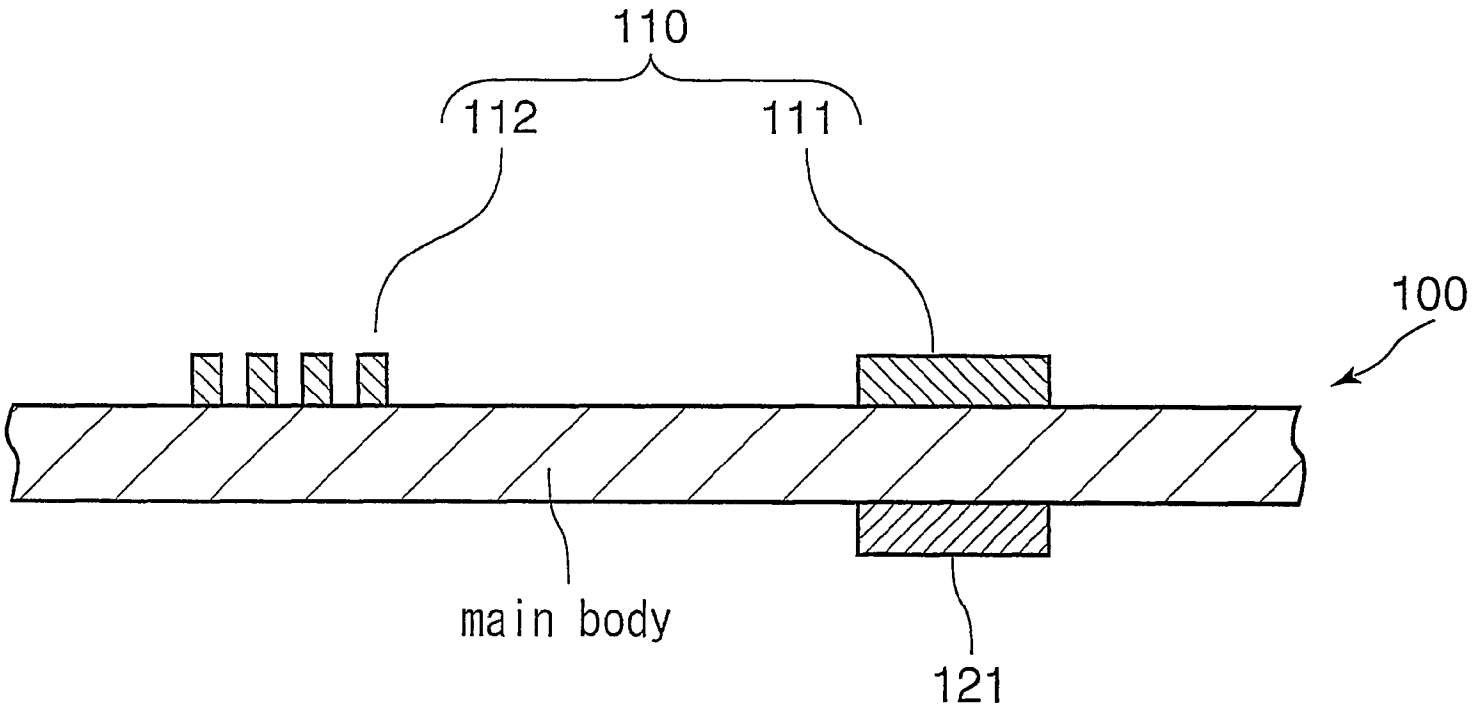
FIG. 1 is a schematic section view of a letterpress printing plate according to an embodiment of the present invention.

For the purposes of illustration, thicknesses of raised parts and buildup parts are shown exaggeratedly, relative to that of the letterpress printing plate.

DESCRIPTION OF THE PREFERRED EMBODIMENTS

Hereinafter, preferred embodiments of the present invention will be described with referent to the drawings.

A letterpress printing plate 100 according to an embodiment of the present invention is a letterpress printing plate formed by a photolithographic technique. The printing plate includes a main body, raised parts 110 provided on a front face of the main body for applying printing ink thereon, and a buildup part 121 formed on a back face of the main body, more particularly, at a backside position of a raised part for solid shade 111 of the raised parts with respect to the main body.

Raised parts 110 of letterpress printing plate 100 of such type are generally classified into a raised part for solid shade 111 for printing a solid area, and the raised part for halftone shade 112 for printing a halftone area.

As shown in FIG. 1, the raised part for solid shade 111 generally projects in the form of a pedestal. The raised part for halftone shade 112 consists of protruded portions to which printing ink adheres and recessed portions to which printing ink does not adheres. The protruded portions and the recessed portions are formed alternately depending on the halftone percentage as will be described later.

The buildup part 121 on the back side of the letterpress printing plate 100 is formed in a step after formation of the raised part 110 on the front side. The buildup part 121 is formed by a so-called inkjet printing machine. The thickness of the buildup part 121 is determined such that during a printing process, substantially the same pressure is applied to a portion (i.e., contact area) of the raised part for solid shade 111 contacting the substrate and to a portion (i.e., contact area) of the raised part for halftone shade 112 contacting the substrate.

The inkjet printing machine is fed, in advance, positional information of the raised part 110 of the letterpress printing plate 100 for which buildup part 121 is to be formed. And this inkjet printing machine sprays ink onto only the area on the back side where the raised part for solid shade 111 is present. As the ink dries, the buildup part 121 is formed.

Figure 2:
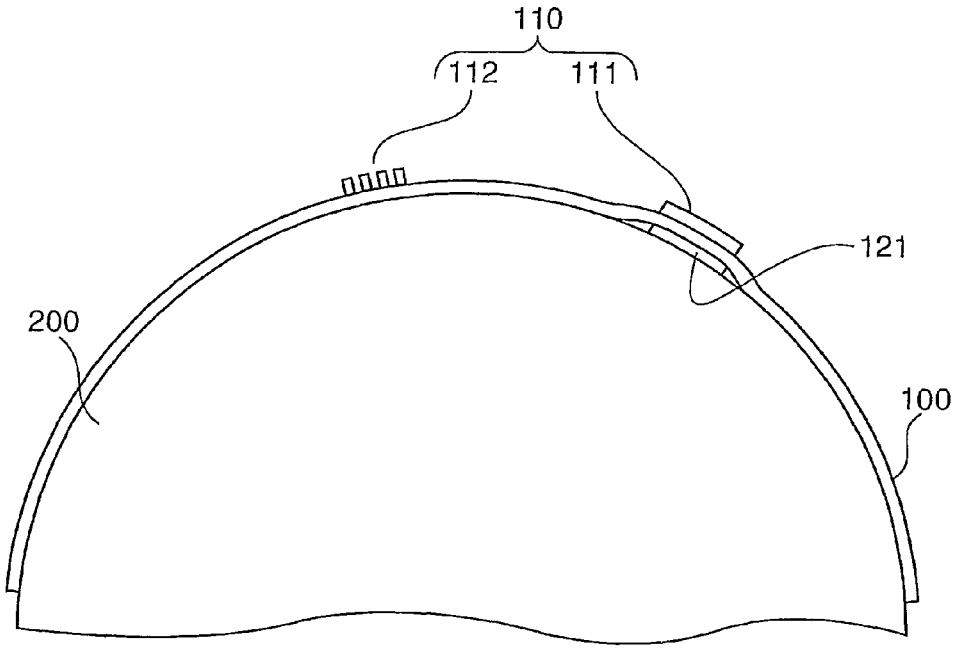
FIG. 2 is a schematic view illustrating printing using the letterpress printing plate according to the embodiment of the present invention.

As shown in FIG. 2, when the letterpress printing plate 100 with the buildup part 121 formed is set on a roller 200 of a printing machine, the raised part for solid shade 111 becomes higher than the raised part for halftone shade 112 by the thickness of the buildup part 121. As printing is conducted on a printing subject in this condition, the raised part for solid shade 111 has already become contact with a printing substrate when the raised part for halftone shade 112 comes into contact with the printing substrate.

In this manner, when an appropriate pressure is applied to the raised part for halftone shade 112, a sufficient and appropriate pressure is applied also to the raised part for solid shade 111, so that excellent printing quality is obtained for both the solid part and the halftone part. More particularly, the thickness of the buildup part 121 functions to equalize the pressure applied to the contact area of the raised part for solid shade 111 and the pressure applied to the contact area of the raised part for halftone shade 112.

Additionally, since the inkjet printing machine previously stores positional information of the raised part for solid shade 111, even when there is a region where the raised part for solid shade 111 and the raised part for halftone shade 112 are intricately mixed, ink is accurately sprayed only on the back side position of the part where the raised part for solid shade 111 is formed. Therefore, the buildup part 121 is accurately formed only at the back side position of the raised part for solid shade 111.

In the aforementioned embodiment, the buildup part 121 is formed only at the back side position of the raised part for solid shade 111 with respect to the main body. In another embodiment to be described below, a buildup part is formed also at a back side position of a raised part for halftone shade with respect to the main body.

Generally speaking, halftone areas with different halftone percentages may be printed on a single printing substrate. "Halftone percentage" herein refers to a contact area contacting a printing substrate per unit area of a raised part for halftone shade. That is, a part having halftone percentage of 0 means that no printing is made on the part, and a part having halftone percentage of 100 is equivalent to a solid shade part.

Assume that the same pressure per unit area, e.g., a pressure that is suited for halftone percentage of 50, is applied on a raised part for halftone shade having halftone percentage of 20 and on another raised part for halftone shade having halftone percentage of 80. In this case, the part of halftone percentage of 20 tends to be slightly squashed and the part of halftone percentage of 80 tends to be blurry because the pressure per contact area is higher for the part of halftone percentage of 20.

Figure 3:
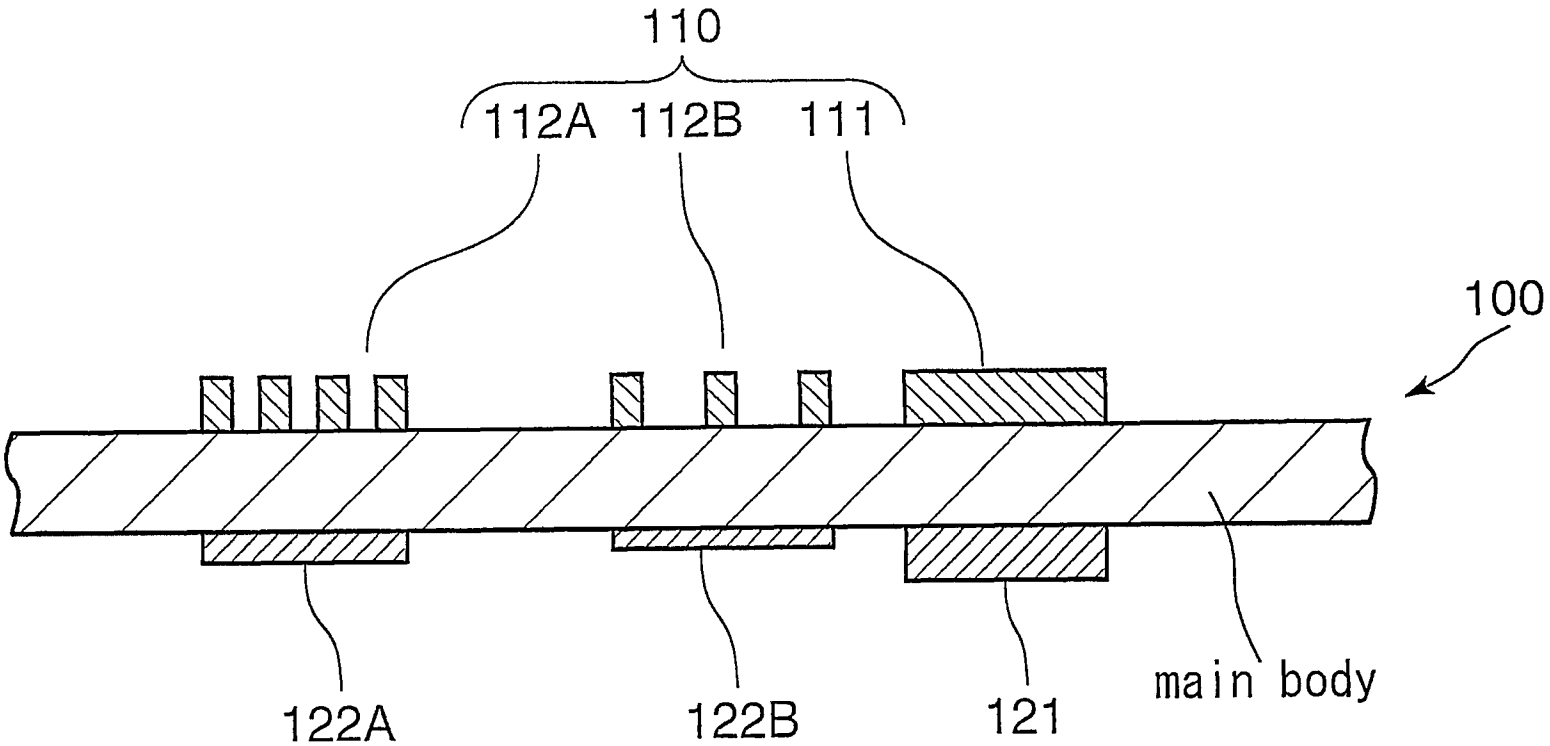
FIG. 3 is a schematic sectional view of a letterpress printing plate according to another embodiment of the present invention.

In order to solve the problem, as shown in FIG. 3, the back face of the main body are provided with buildup parts for halftone shade 122A, 122B, at back side positions of raised parts for halftone shade 112A, 112B, respectively. The heights (thicknesses) of the buildup parts correspond to respective halftone percentages thereof.

To be more specific, at a back side position of the raised part for halftone shade 112A having a higher halftone percentage, there is formed the buildup part for halftone shade 122A with a larger thickness. This thickness is smaller than that of the buildup part (the buildup part for sold shade) 121 formed at the back side position of the raised part for solid shade 111. On the other hand, at a back side position of the raised part for halftone shade 112B having a lower halftone percentage, there is formed the buildup part for halftone shade 122B with a smaller thickness than the buildup part 122A.

As a result, halftone parts are appropriately printed regardless of the degree of halftone percentage.

Also in this embodiment, the back face of the main body is provided with the buildup part for solid shade 121 at the position corresponding to the raised part for solid shade 111. The thickness of the buildup part for solid shade 121 is larger than those of buildup parts for halftone shade 112A, 112B.

Also in this embodiment, the buildup parts 121, 122A, 122B are formed by an inkjet printing machine which stores positional information of all raised parts for solid shade 111 and raised parts for halftone shade 121A, 121B. Information entered into the inkjet printing machine includes not only the aforementioned positional information, but also information about halftone percentage of each of the raised parts for halftone shade 122A, 122B. Therefore, it is possible to accurately form the buildup parts for halftone shade 122A, 122B each having thickness corresponding to its halftone percentage.

Although the above embodiment discloses a letterpress printing plate formed by a photolithographic technique as a representative of a letterpress printing plate, it goes without saying that the present invention will not be limited to this kind of printing plate. For example, a laser processing technique or other techniques may be used to form the buildup part for sold shade 121 and the buildup part for halftone shade 122 (122A, 122B) on the back face of the main body.

Further, the printing plate may be of any type made of a material having flexibility such as one used for polymer letterpress printing or rubber plate printing, as well as flexography printing.

What is claimed is:

1. A letterpress printing plate made of a material having flexibility, comprising:

a first face;

a second face being opposite the first face of the letterpress printing plate;

a plurality of raised parts for applying printing ink to, the raised parts being provided on the first face, and a plurality of buildup parts formed on the second face at backside positions of the raised parts with respect to the printing plate, the raised parts including a raised part for solid shade and a raised part for halftone shade, the raised part for solid shade and the raised part for halftone shade being of a same height, the buildup parts including:

a buildup part for solid shade, formed on the second face at a backside position of the raised part for solid shade; and a buildup part for halftone shade, formed on the second face at a backside position of the raised part for halftone shade and being of a thickness smaller than the buildup part for solid shade, the thickness being set in accordance with a halftone percentage of the raised part for halftone shade, and the buildup parts being formed of ink.

2. The letterpress printing plate according to claim 1, which is formed by a photolithography technique.

* * * * *